US005914657A

United States Patent [19]

Chen

[11] Patent Number: 5,914,657

[45] Date of Patent: Jun. 22, 1999

[54] WALLET CAPABLE OF PREVENTING LOSS OF CARDS KEPT THEREIN

[76] Inventor: Vencent Chen, No. 162, Wu-Chuan-West 2 .St, Taichung, Taiwan

[21] Appl. No.: 09/105,796

[22] Filed: Jun. 26, 1998

[51] Int. Cl.[6] ..... G08B 13/14

[52] U.S. Cl. ..... 340/568.7; 340/600

[58] Field of Search ..... 340/568.7, 600, 340/693.5, 522

[56] References Cited

U.S. PATENT DOCUMENTS 4,692,745 9/1987 Simanowitz ..... 340/568.7
4,719,453 1/1988 Beck et al. ..... 340/568.7
4,890,094 12/1989 Kopel ..... 340/568.7
4,916,434 4/1990 McNeely ..... 340/568.7

*Primary Examiner*—Thomas Mullen
*Attorney, Agent, or Firm*—W. Wayne Liauh

[57] ABSTRACT

A wallet having a plurality of card slots for holding the credit cards, the charge cards, etc. The card slots are provided with a sensing circuit, an IC circuit board connected in series with a buzzer and a photo sensor. The buzzer is not activated when a card is removed from one of the card slots. The buzzer is activated when the card is not returned to the card slot and when the wallet remains unfolded such that the photo sensor is exposed to light.

1 Claim, 11 Drawing Sheets

WALLET CAPABLE OF PREVENTING LOSS OF CARDS KEPT THEREIN

FIELD OF THE INVENTION

The present invention relates generally to a wallet, and more particularly to a wallet which is provided with a means to prevent the loss of the plastic cards kept in the wallet.

BACKGROUND OF THE INVENTION

A wallet is a handy place to keep all kinds of the plastic cards, such as credit card, charge card, bank card, ID card, etc. However, these cards are often lost or stolen, thereby resulting in a great deal of inconvenience and monetary loss to the card holder. In order to prevent the loss of the cards kept in a wallet, the wallet is provided with an electrical device capable of buzzing at the time when a card is removed from the card slot of the wallet. The card slot is provided with two metal sheets which are connected with a battery and a buzzer. When the card is removed from the space between the two metal sheets, the circuit is connected with the battery to result in the buzzing of the buzzer. As the card is put back into the space between the two metal sheets, the circuit is disconnected with the battery, thereby resulting in the inactivation of the buzzer. Such a conventional wallet as described above is relatively heavy in light of the metal sheets which are contained in the card slots of the wallet. An improved wallet is provided with a printed circuit in place of the metal sheets, as shown in FIG. 1. The printed circuit comprises a plastic sheet 1 on which a sensing circuit is printed. The sensing circuit is composed of two parallel conductive circuits 2 and 3, which are formed of the electrically conductive ink and are connected with a circuit board 4 which is in turn connected with a power source as well as a buzzer 5. As shown in FIG. 2, the plastic sheet 1 is folded and then inserted into the card slots of the wallet such that the conductive circuits 2 and 3 are opposite to each other. After the prolonged use of the wallet, the printed circuit becomes unreliable in view of the fact that the plastic sheet 1 lacks elasticity, thereby resulting in the poor contact between the two conductive circuits 2 and 3. The poor contact can be also caused by the loosening of the card slots. The two prior art wallets described above share a common drawback in such a manner that the buzzer keeps making a buzzing sound as long as the card or cards are removed from the card slots, thereby causing a great deal of annoyance not only to the wallet owner but also the people around the wallet owner.

SUMMARY OF THE INVENTION

The primary objective of the present invention is therefore to provide an improved wallet free from the drawbacks of the prior art wallets described above.

In keeping with the principle of the present invention, the foregoing objective of the present invention is attained by a wallet having a plurality of card-holding slots provided with a sensing circuit, an IC circuit board having a buzzer, and a photo sensor. The buzzer is not activated when a card is removed from one of the card-holding slots. However, the buzzer is activated when the card is not returned to the card-holding slot from which the card was removed in the first place.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
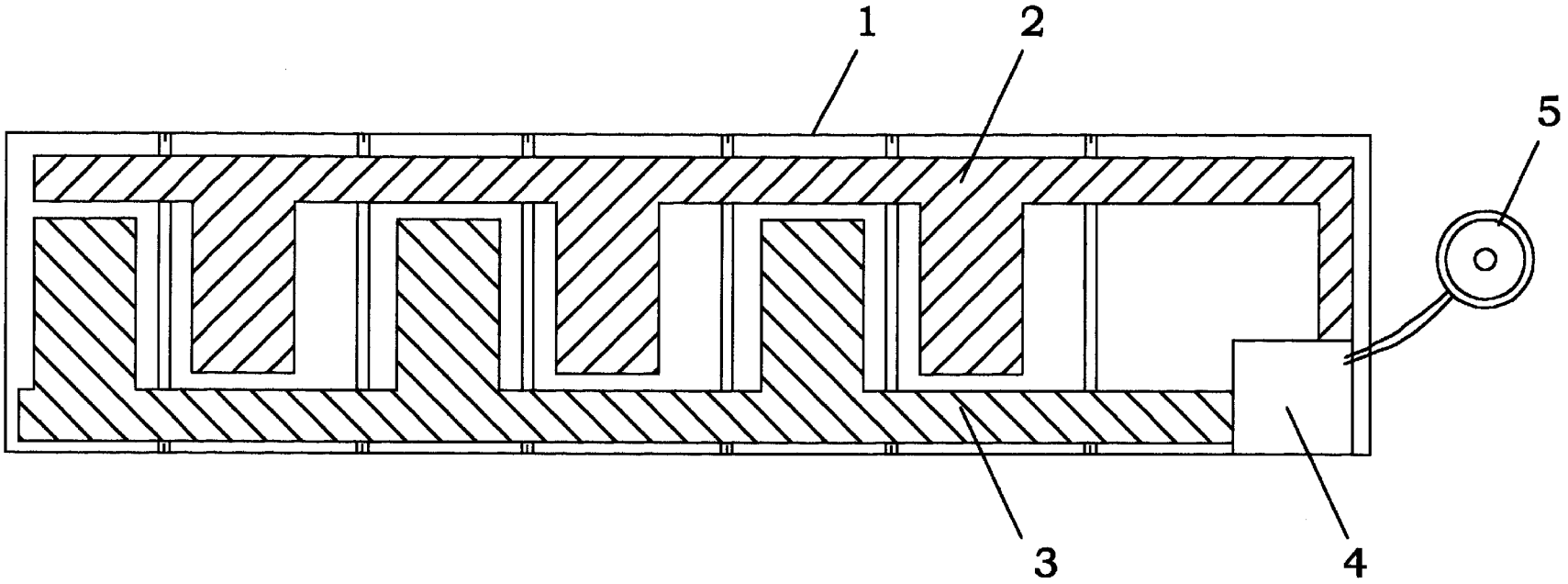
Fig. 1 PRIOR ART
FIG. 1 shows a schematic view of a plastic sheet of a prior art wallet.
Figure 2:
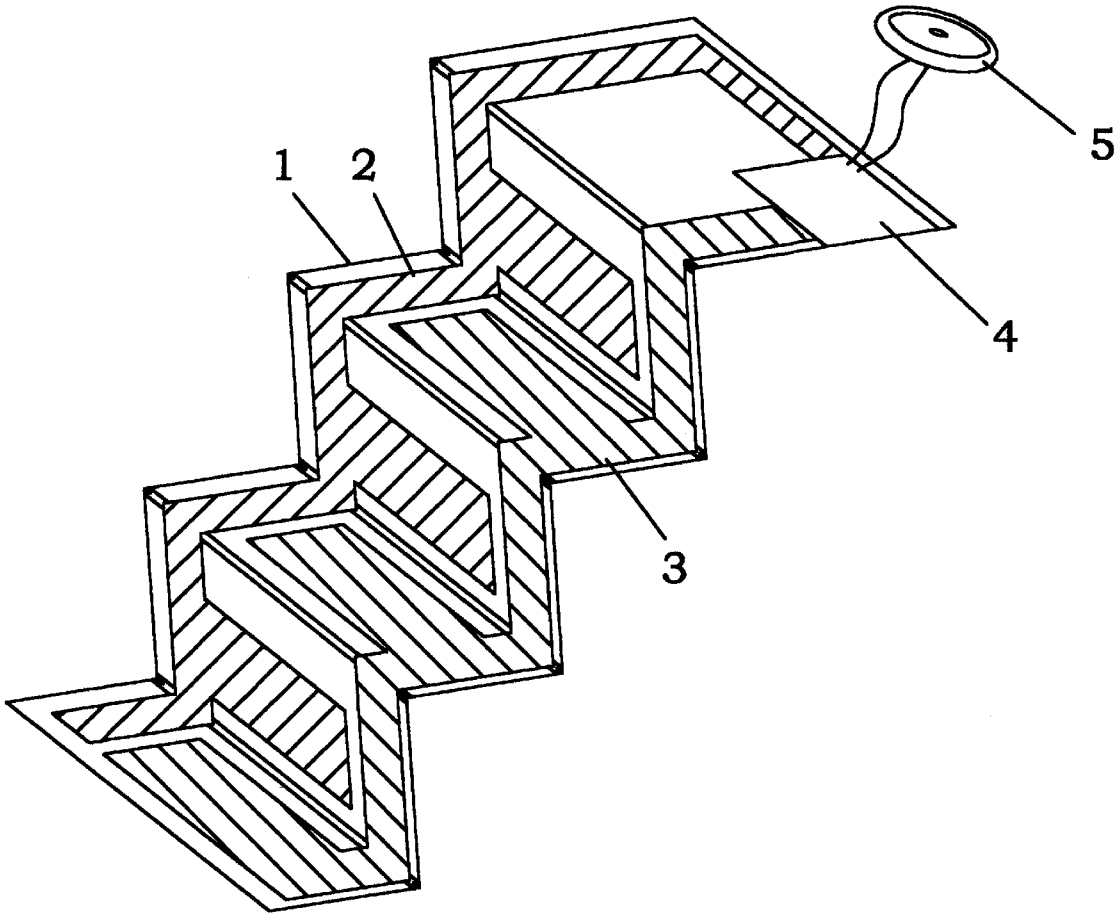
Fig. 2 PRIOR ART
FIG. 2 shows a schematic view of the folded plastic sheet of the prior art wallet.
Figure 3:
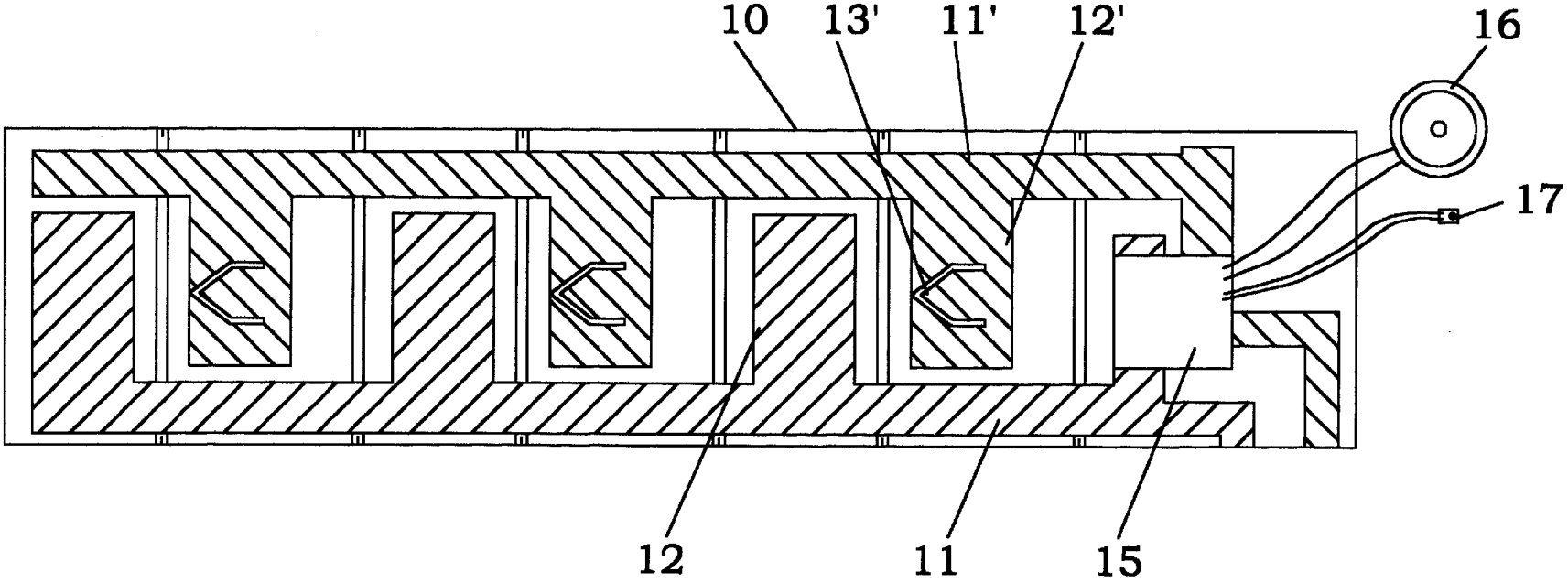
FIG. 3 shows a schematic view of a plastic sheet of the present invention.
Figure 4:
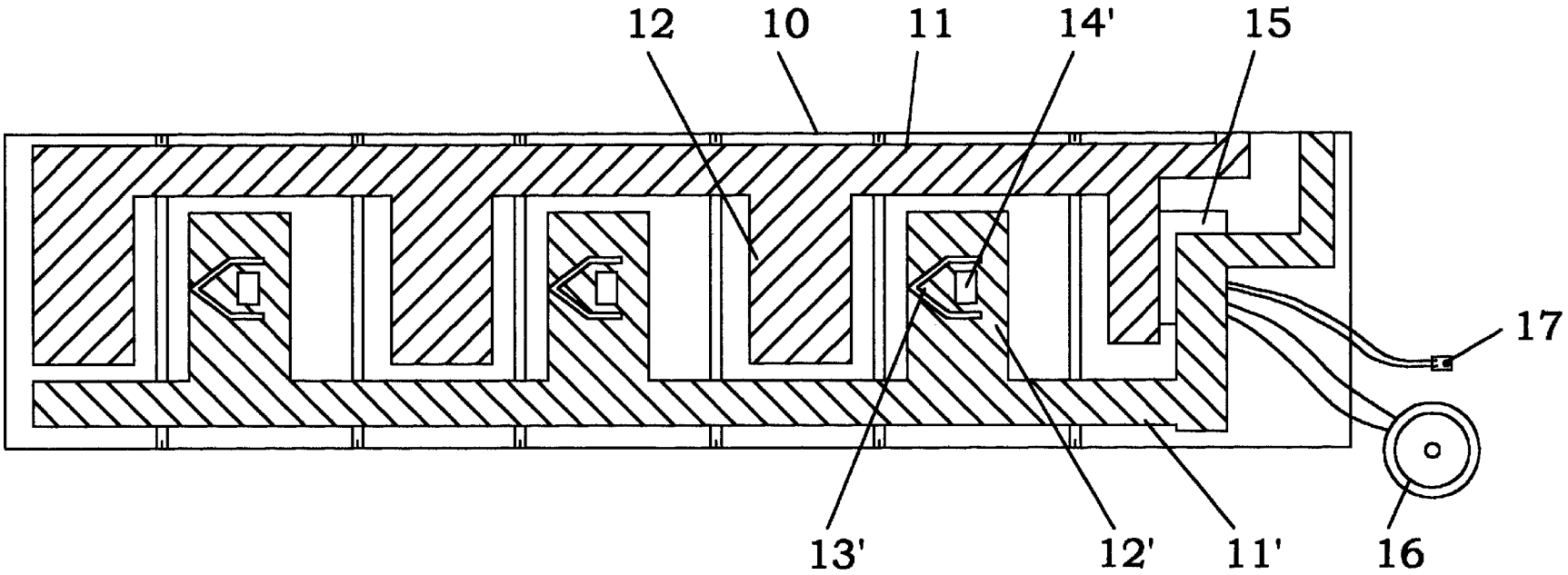
FIG. 4 shows a rear view of the plastic sheet of the present invention.

As shown in FIGS. 3 and 4, the present invention comprises a plastic sheet 10 on which a layer of sensing circuit is printed by using the electrically conductive ink. The plastic sheet 10 is provided with two conductive circuits 11 and 11' parallel to each other and extending inward to form two corresponding connection circuits 12 and 12'. The connection circuit 12' is provided with an inverted tapered movable piece 13' which is provided in the back thereof with a thin elastic foam body 14' attached thereto. The two parallel conductive circuits 11 and 11' are connected respectively at one end thereof with a circuit board 15, which is connected with a small battery serving as a power source. The circuit board 15 is further connected in series with a buzzer 16 and a photo sensor 17.

Figure 5:
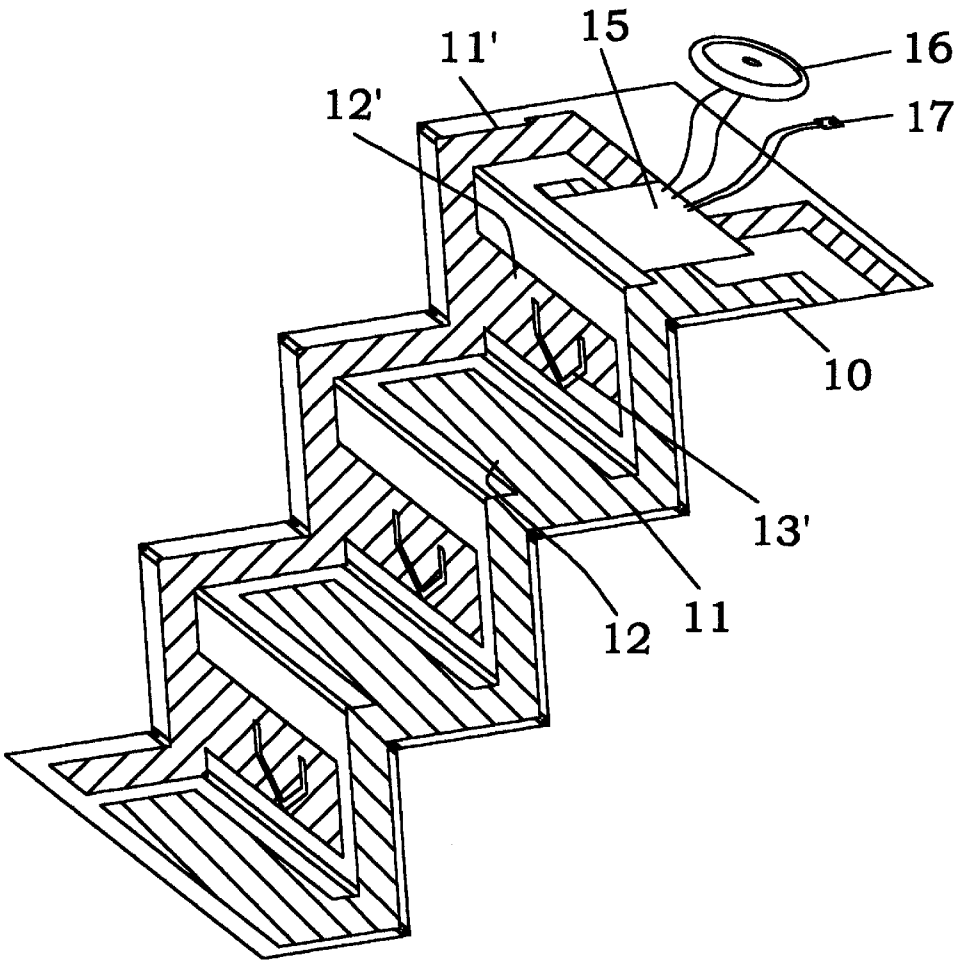
FIG. 5 shows a schematic view of the folded plastic sheet of the present invention.
Figure 6:
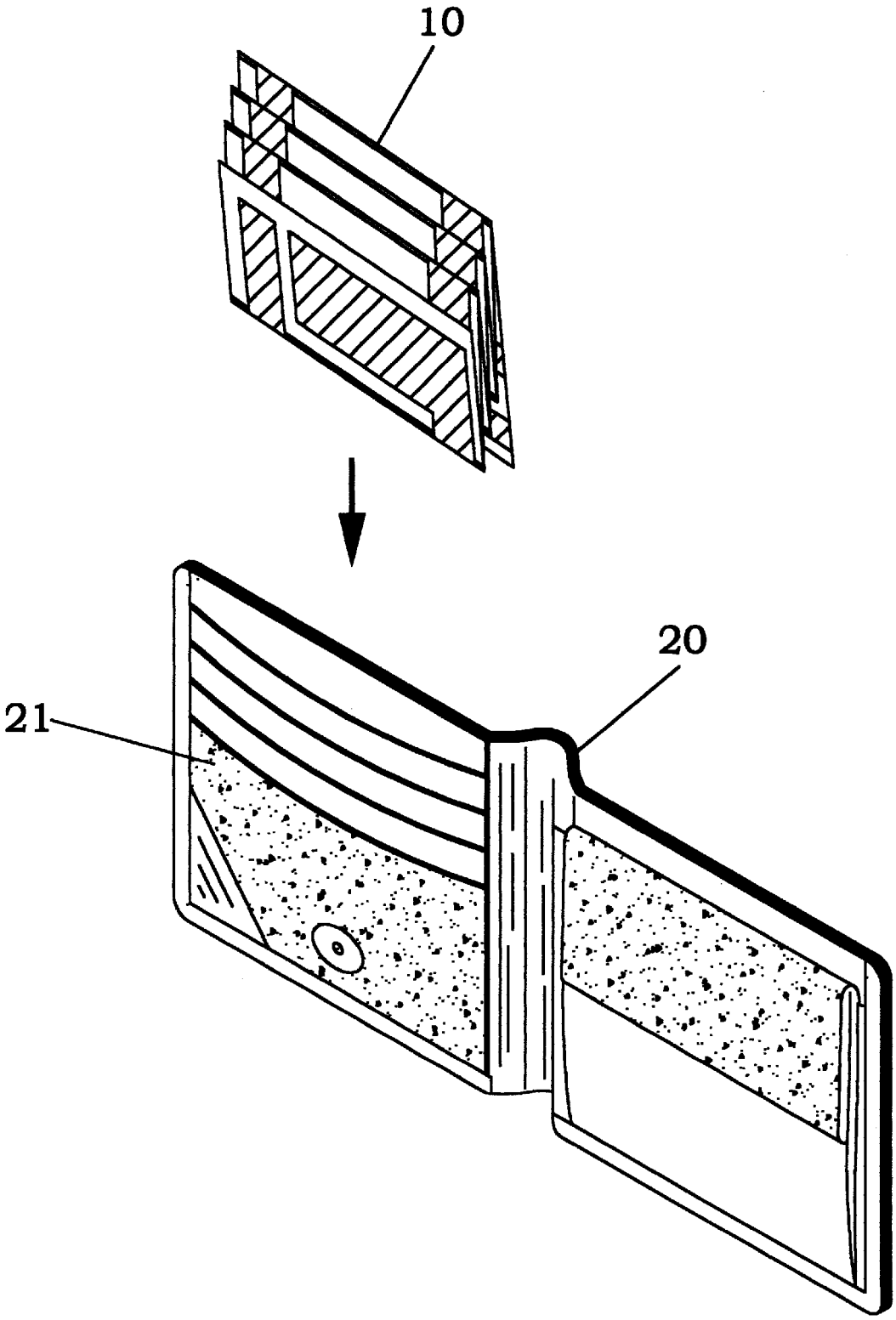
FIG. 6 shows a schematic view of the assembling of the present invention.
Figure 7:
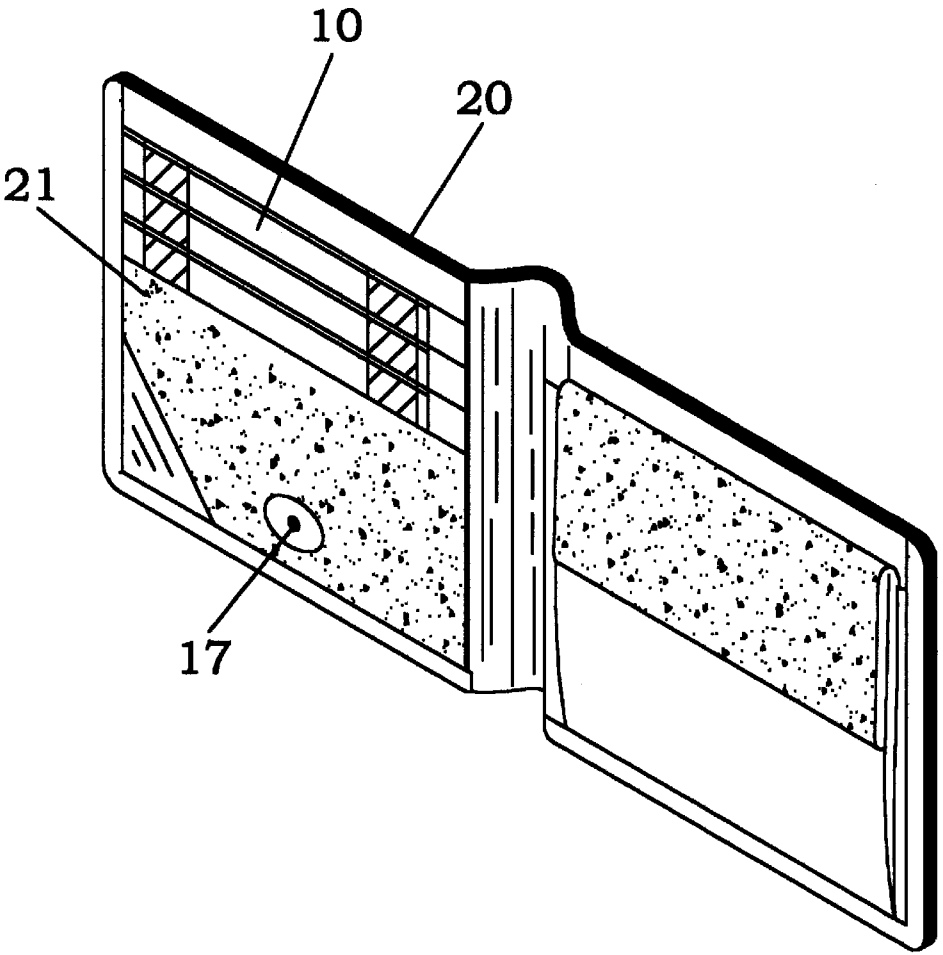
FIG. 7 shows a schematic view of the present invention in combination.
Figure 8:
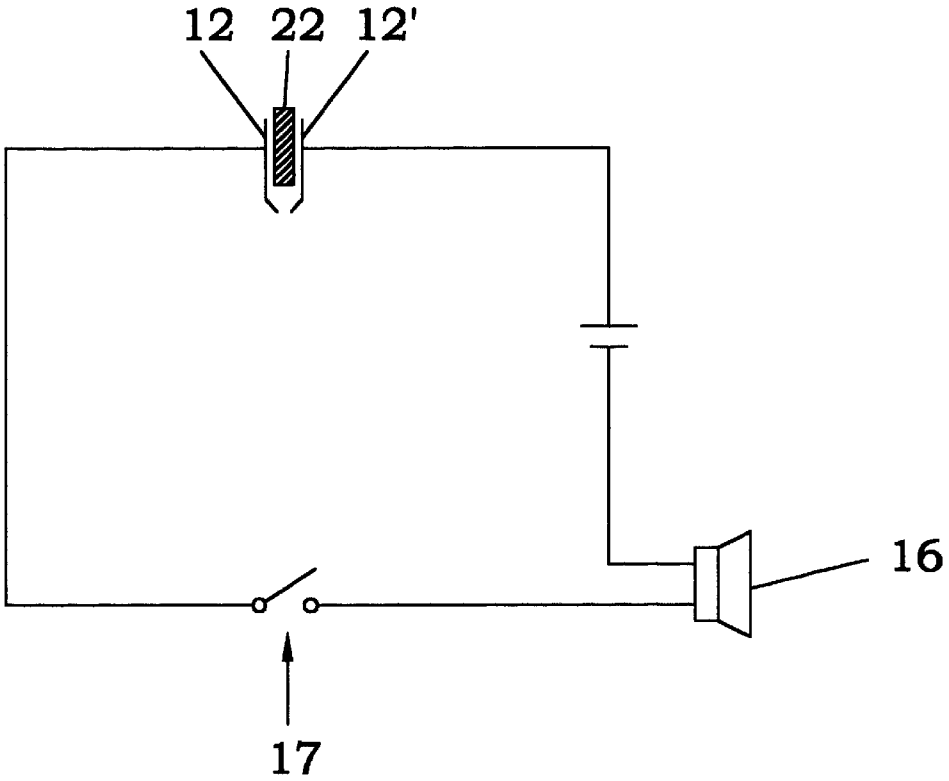
FIG. 8 shows a schematic view of a control circuit of the present invention.
Figure 9:
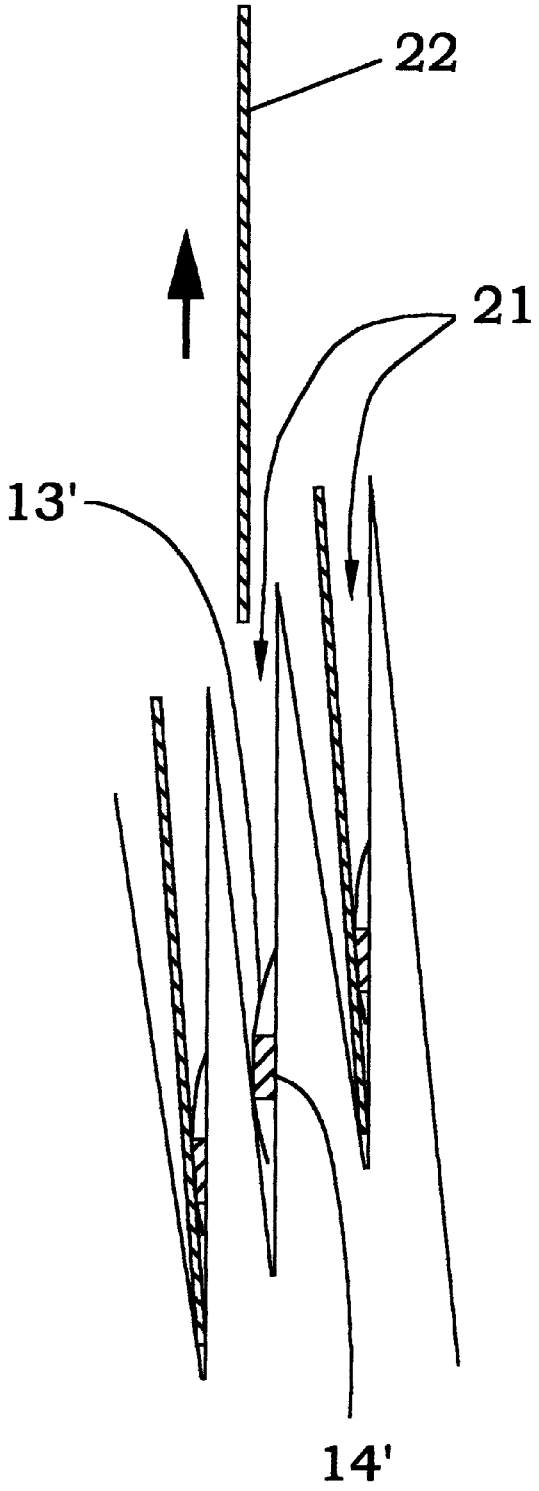
FIG. 9 shows a schematic view of the sensing circuit of the present invention at work.
Figure 10:
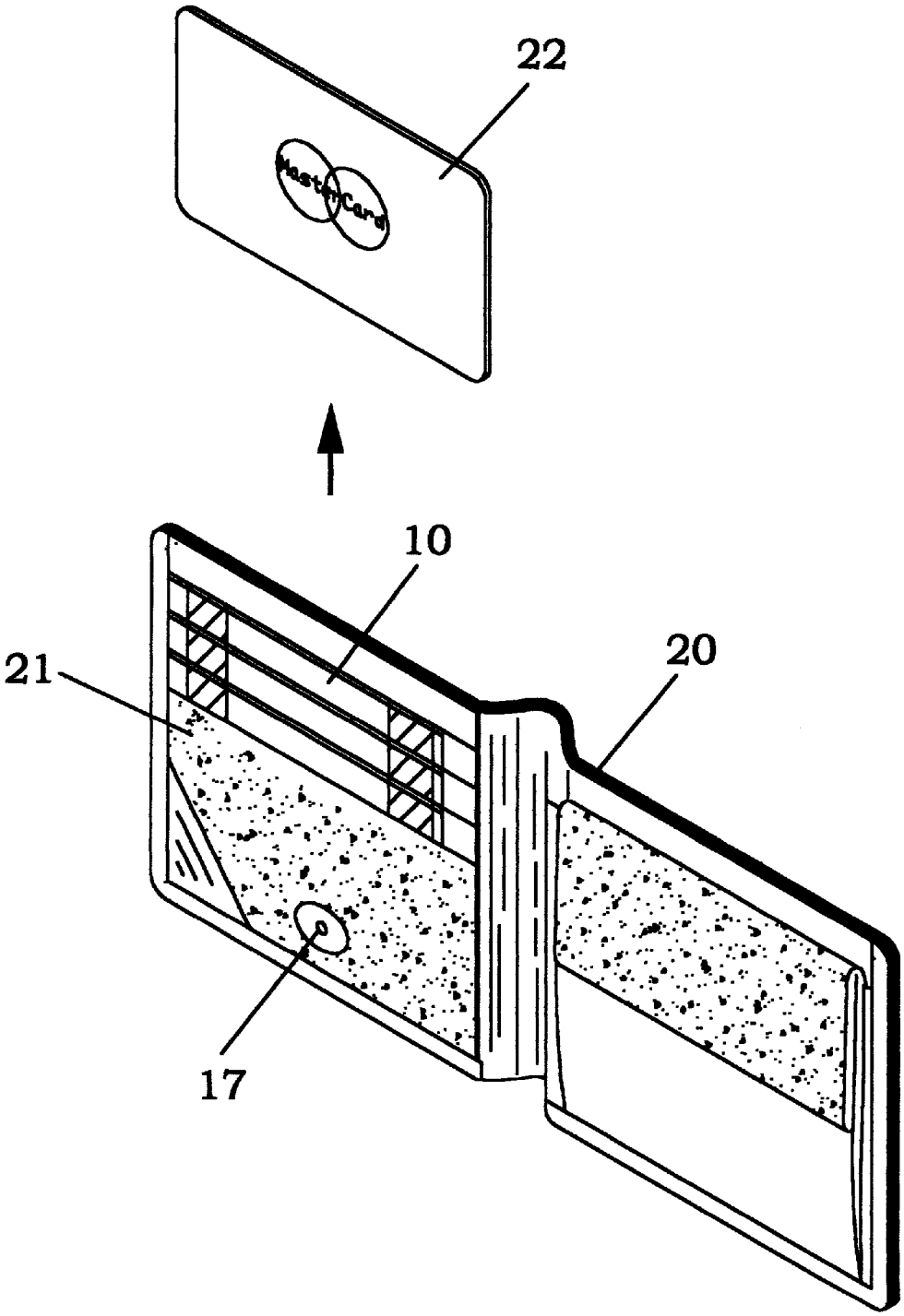
FIG. 10 shows a schematic view of an embodiment of the present invention.
Figure 11:
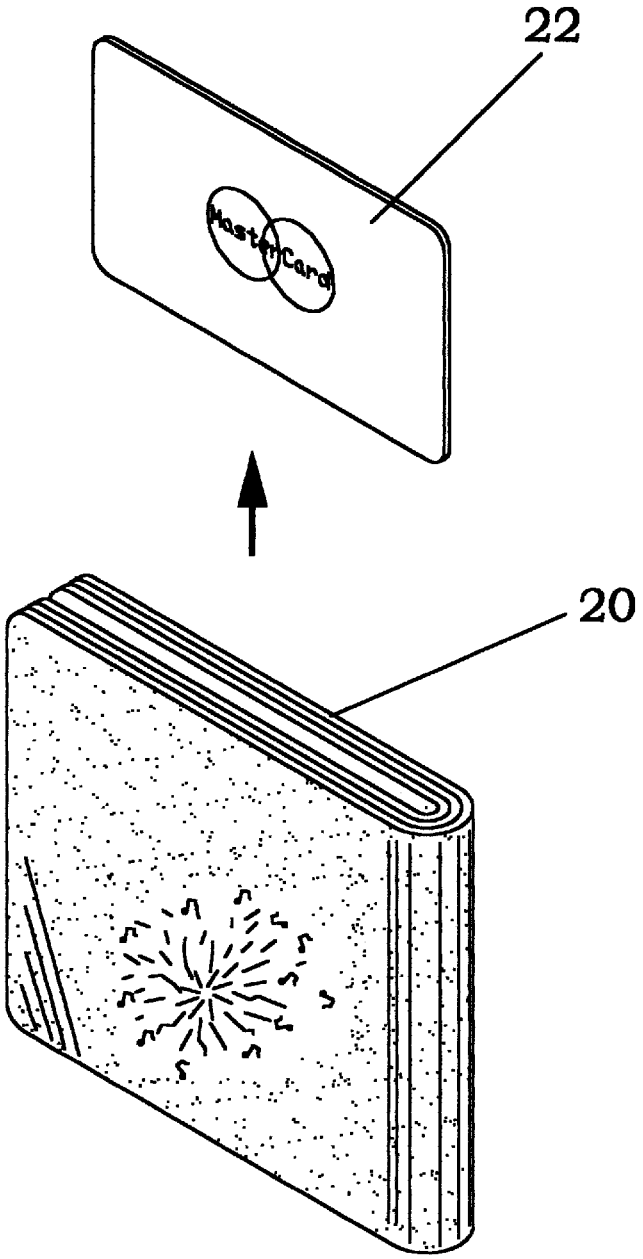
FIG. 11 shows a schematic view of another embodiment of the present invention.

As shown in FIGS. 5, 6, and 7, the plastic sheet 10 is first folded and then inserted into the card slots 21 of a wallet 20 such that the plastic sheet 10 is joined with the card slots 21 by sewing, and that the photo sensor 17 is attached nakedly to a piece of cloth of the wallet 20. As illustrated in FIGS. 7 and 8, the conductive circuits 11 and 11' can not form a loop before the plastic sheet 10 is folded. However, when the plastic sheet 10 is folded such that the connection circuits 12 and 12' are in contact with each other, the conductive circuits 11 and 11' form a loop to result in the buzzing of the buzzer 16. In light of the present invention being provided with the photo sensor 17, the activation of the buzzer 16 can not be brought about without the participation of the photo sensor 17. As illustrated in FIG. 10, a card 22 is removed from the card slot 21 of the wallet 20 which is unfolded such that the photo sensor 17 is exposed to light, and that the photo sensor 17 remains in the "OFF" state. As a result, the buzzer 16 remains inactivated. As shown in FIG. 11, the wallet 20 is folded without the card 22 being put back into the card slot 21 of the wallet 20, the photo sensor 17 is no longer exposed to light such that the photo sensor 17 remains in the "ON" state, thereby resulting in the activation of the buzzer 16. The owner of the wallet 20 is thus reminded of the fact that the card 22 has not been returned to the card slot 21 of the wallet 20.

After the prolonged use of the wallet 20 of the present invention, the warning device of the present invention remains in good working condition in light of the connection circuit 12' which is provided with the movable piece 13' having the elastic foam body 14'. When the card 22 is taken out of the card slot 21, the movable piece 13' is pushed forward by the elasticity of the elastic foam body 14' to make contact with another connection circuit 12. In other words, the connection circuits 12' and 12 work with precision even after the prolonged use of the wallet 20 of the present invention.

The embodiment of the present invention described above is to be deemed in all respects as being merely illustrative and not restrictive. Accordingly, the present invention may be embodied in other specific forms without deviating from the spirit thereof. The present invention is therefore to be limited only by the scope of the following appended claim.

What is claimed is:

1. A wallet comprising:

a plurality of card slots and a piece of cloth attached to an inner side of the wallet;

a plastic sheet provided with two parallel conductive circuits and two connection circuits, one of said two connection circuits being provided with a movable piece having an elastic foam body attached thereto, said plastic sheet being folded to fasten securely inside said card slots; and a circuit board located in said card slots such that said circuit board is connected with said two conductive circuits, and that said two conductive circuits form a loop with said circuit board at such time when said two connection circuits make contact with each other, said circuit board being further connected with a power source, a buzzer, and a photo sensor which is attached nakedly to said piece of cloth of the wallet such that said photo sensor is exposed to light at such time when the wallet is unfolded.

* * * * *